US010083582B2

(12) United States Patent
Wu et al.

(10) Patent No.: US 10,083,582 B2
(45) Date of Patent: Sep. 25, 2018

(54) DATA COLLECTION AND PROCESSING APPARATUS WITH ANTI-THEFT FUNCTION, SYSTEM USING THE SAME, AND DATA COLLECTION AND PROCESSING METHOD THEREOF

(71) Applicants: QUASION INC., Ontario (CA); Xiaohua Wu, Beijing (CN)

(72) Inventors: Xiaohua Wu, Beijing (CN); Ziyue Ouyang, Beijing (CN)

(73) Assignees: QUASION INC., Ontario (CA); Xiaohua Wu, Beijing (CN)

( * ) Notice: Subject to any disclaimer, the term of this patent is extended or adjusted under 35 U.S.C. 154(b) by 0 days.

(21) Appl. No.: 15/123,673

(22) PCT Filed: Mar. 4, 2014

(86) PCT No.: PCT/CN2014/072793
§ 371 (c)(1),
(2) Date: Sep. 5, 2016

(87) PCT Pub. No.: WO2015/131309
PCT Pub. Date: Sep. 11, 2015

(65) Prior Publication Data
US 2017/0221327 A1 Aug. 3, 2017

(51) Int. Cl.
*G08B 13/12* (2006.01)
*G08B 25/10* (2006.01)
(Continued)

(52) U.S. Cl.
CPC ..... *G08B 13/12* (2013.01); *G08B 25/10* (2013.01); *G08B 13/149* (2013.01); *G08B 25/08* (2013.01)

(58) Field of Classification Search
CPC ..... G08B 13/12; G06F 21/88; G06F 21/31; G06F 21/60; E05B 73/00; Y10T 70/5004
(Continued)

(56) References Cited

U.S. PATENT DOCUMENTS 7,209,038 B1 * 4/2007 Deconinck ..... G08B 13/1409 340/541
7,403,117 B2 * 7/2008 Leyden ..... G08B 13/149 340/568.2
(Continued)

FOREIGN PATENT DOCUMENTS

CN 102069769 5/2011
CN 202196480 4/2012
(Continued)

OTHER PUBLICATIONS

1. Extended European Search Report dated Nov. 27, 2017 for EP Application No. 14885013.4 2. Office Action dated Dec. 19, 2017 for JP Application No. 2016-555587.

*Primary Examiner* — Toan N Pham
(74) *Attorney, Agent, or Firm* — Chieh-Mei Wang

(57) ABSTRACT

A data collection and processing apparatus with anti-theft function, a system using the apparatus and a data collection and processing method thereof are provided. The method includes the steps of: collecting relevant information regarding at least one targeted object, wherein the relevant information includes status information, operational information, environmental information of the targeted object, and user information of an owner or user of the targeted object; and performing an alarm when detecting that the targeted object is not under a normal status. The data collection and processing apparatus includes a transducer module, a master control module and an alarm and data processing module, which may form a local network connection or a distributed data processing network. In addition to performing anti-theft
(Continued)

function, the present invention is capable of collecting various relevant information of the protected object. Therefore, the present invention is particularly useful in public establishments, such as retailers, exhibitions, hotels and banks, for merchants or owners to assess the use of their displayed merchandises or service facilities.

14 Claims, 8 Drawing Sheets

(51) Int. Cl.
*G08B 13/14* (2006.01)
*G08B 25/08* (2006.01)

(58) Field of Classification Search
USPC ..... 340/568.2, 568.1, 568.8, 571
See application file for complete search history.

(56) References Cited

U.S. PATENT DOCUMENTS

| | | | | |
|---|---|---|---|---|
| 8,212,672 | B2 * | 7/2012 | Brenner | G09F 27/00 340/568.1 |
| 8,994,531 | B2 * | 3/2015 | Fawcett | G08B 13/1436 340/568.1 |
| 9,367,865 | B2 * | 6/2016 | Treiser | G06Q 30/0609 |
| 2009/0091448 | A1 | 4/2009 | Leyden et al. | |

FOREIGN PATENT DOCUMENTS

| | | |
|---|---|---|
| GB | 2483096 | 2/2012 |
| JP | 2009532121 | 9/2009 |
| JP | 2013538406 | 10/2013 |

* cited by examiner

DATA COLLECTION AND PROCESSING APPARATUS WITH ANTI-THEFT FUNCTION, SYSTEM USING THE SAME, AND DATA COLLECTION AND PROCESSING METHOD THEREOF

FIELD OF THE INVENTION

The present invention relates to a data collection and processing apparatus, and more particularly to a data collection and processing apparatus with anti-theft function, a system using the apparatus, and a data collection and processing method thereof.

BACKGROUND OF THE INVENTION

Display of merchandises or service facilities is common in public establishments such as retailer stores, exhibitions, hotels, and banks. For business development and/or security purposes, surveillance cameras or security personnel are usually set on site for allowing merchants or owners to monitor their merchandises or service facilities. However, such methods are disadvantageous for the following reasons.

1. Images acquired by surveillance cameras have to be analyzed by human, often resulting in incomplete statistical observation or missing data.

2. On-site human observation affects user behaviors, reducing the accuracy of statistical analysis.

3. Camera surveillance or human on-site observation cost delay in discovery of issues, and timely interaction with the users regarding such issues are not possible.

4. Additional anti-theft devices are required to secure displayed merchandises or services facilities, increasing the cost of business operation.

Nevertheless, none of the existing anti-theft devices is capable of data collection or assessing the use of displayed merchandises or service facilities.

BRIEF SUMMARY OF THE INVENTION

The technical issues to be solved by the present invention are that existing anti-theft devices are neither capable of collecting data on the use of displayed merchandises or service facilities nor providing interactive operations regarding the targeted objects.

To solve the aforementioned technical issues, the present invention provides a data collection and processing apparatus with anti-theft function. The anti-theft data collection and processing apparatus is configured for collecting and processing relevant information regarding at least one targeted object. The relevant information includes information indicating whether the targeted object is under a normal status. The data collection and processing apparatus is configured for processing the relevant information and performing an alarm when detecting that the targeted object is not under the normal status.

According to a preferred embodiment of the present invention, the relevant information includes at least one of: status information, operational information, environmental information of the targeted object, and user information of an owner or a user of the targeted object.

According to a preferred embodiment of the present invention, the data collection and processing apparatus includes a transducer module, a master control module and an alarm and data processing module. The transducer module is configured for collecting the relevant information of the targeted object. The master control module is configured for determining if the targeted object is under the normal status, transmitting an alert signal to the alarm and data processing module when the targeted object is determined to be not under the normal status, and transmitting the relevant information received from the transducer module to the alarm and data processing module. The alarm and data processing module is configured for processing the alert signal received from the master control module, performing an alarm, and processing the relevant information transmitted by the master control module and performing corresponding interactive operations.

According to a preferred embodiment of the present invention, the data collection and processing apparatus further includes a storage module configured for storing the relevant information and data generated by the master control module or generated upon processing of the relevant information by the alarm and data processing module.

According to a preferred embodiment of the present invention, the data collection and processing apparatus further includes a communication module configured for transmitting the alert signal received from the master control module to an external device capable of processing the alert signal, and transmitting the relevant information of the targeted object acquired by the transducer module to the external device capable of processing the relevant information.

The present invention also provides a data collection and processing system with anti-theft function. The data collection and processing system includes at least one data collection and processing apparatus and an alarm and data processing apparatus. The data collection and processing apparatus communicates with the alarm and data processing apparatus via a wired or wireless connection. The data collection and processing apparatus is configured for collecting relevant information regarding at least one targeted object and transmitting the relevant information to the alarm and data processing apparatus. The relevant information includes information indicating whether the targeted object is under a normal status. The alarm and data processing apparatus is configured for processing the relevant information and performing an alarm when detecting that the targeted object is not under the normal status.

According to a preferred embodiment of the present invention, the relevant information includes at least one of: status information, operational information, environmental information of the targeted object, and user information of an owner or a user of the targeted object.

According to a preferred embodiment of the present invention, the data collection and processing apparatus includes a transducer module, a master control module and a communication module. The transducer module is configured for collecting the relevant information of the targeted object. The master control module is configured for determining if the targeted object is under the normal status, transmitting an alert signal to the alarm and data processing module when the targeted object is determined to be not under the normal status, and transmitting the relevant information received from the transducer module to the alarm and data processing module. The communication module is configured for transmitting the alert signal received from the master control module to the alarm and data processing apparatus, and transmitting the relevant information of the targeted object acquired by the transducer module to the alarm and data processing apparatus.

According to a preferred embodiment of the present invention, the data collection and processing apparatus further includes an alarm and data processing module. The alarm and data processing module is configured for processing the alert signal received from the master control module, performing an alarm, and processing the relevant information transmitted by the master control module and performing corresponding interactive operations. The master control module is also configured for determining if sending the alert signals and relevant information to the alarm and data processing module or to the alarm and data processing apparatus.

According to a preferred embodiment of the present invention, the data collection and processing apparatus further includes a storage module configured for storing the relevant information and data generated by the master control module or generated upon processing of the relevant information by the alarm and data processing module.

The present invention also provides another data collection and processing system with anti-theft function. The data collection and processing system includes at least one data collection and processing apparatus and a cloud server. The data collection and processing apparatus communicates with the cloud server via a wired or wireless connection. The data collection and processing apparatus includes a transducer module, a master control module, an alarm and data processing module and a communication module. The transducer module is configured for collecting relevant information regarding at least one targeted object. The master control module is configured for determining if the targeted object is under the normal status, transmitting an alert signal to the alarm and data processing module when the targeted object is determined to be not under the normal status, and transmitting the relevant information received from the transducer module to the alarm and data processing module or the cloud server. The alarm and data processing module is configured for processing the relevant information and performing an alarm when detecting that the targeted object is not under the normal status, and processing the relevant information transmitted by the master control module and performing corresponding interactive operations. The communication module is configured for transmitting the alert signal received from the master control module to the alarm and data processing module, and transmitting the relevant information of the targeted object acquired by the transducer module to the alarm and data processing module or the cloud server. The cloud server is configured for receiving and processing the relevant information of the targeted object from the data collection and processing apparatus and transmitting processing results to the data collection and processing apparatus for the data collection and processing apparatus to perform interactive operations.

According to a preferred embodiment of the present invention, the relevant information includes at least one of: status information, operational information, environmental information of the targeted object, and user information of an owner or a user of the targeted object.

According to a preferred embodiment of the present invention, the data collection and processing apparatus further includes a storage module configured for storing the relevant information and data generated by the master control module or generated upon processing of the relevant information by the alarm and data processing module.

The present invention also provides a data collection and processing method. The data collection and processing method includes the steps of: collecting relevant information regarding at least one targeted object, wherein the relevant information includes information indicating whether the targeted object is under a normal status; and determining if the target object is under the normal status, and performing an alarm when determining that the targeted object is not under the normal status.

According to a preferred embodiment of the present invention, the data collection and processing method further includes a step of: processing the collected relevant information and performing corresponding interactive operations.

According to a preferred embodiment of the present invention, the relevant information is processed by a distributed data collection and processing system.

In addition to performing existing anti-theft functions, the data collection and processing apparatus, system and method of the present invention is capable of collecting status and operational information of the protected objects. Therefore, the present invention is particularly useful in public establishments, such as retailers, exhibitions, hotels and banks, for merchants or owners to assess the use of their displayed merchandises or service facilities.

Furthermore, the present invention is also capable of receiving alert signals or status and operational information from any data collection and processing apparatus, and providing alarms according to the alert signals or interactive operations according to the status or operational information, therefore enhanced user experience of the present invention.

For making the above and other purposes, features and benefits become more readily apparent to those ordinarily skilled in the art, the preferred embodiments and the detailed descriptions with accompanying drawings will be put forward in the following descriptions.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF THE INVENTION

Figure 1A:
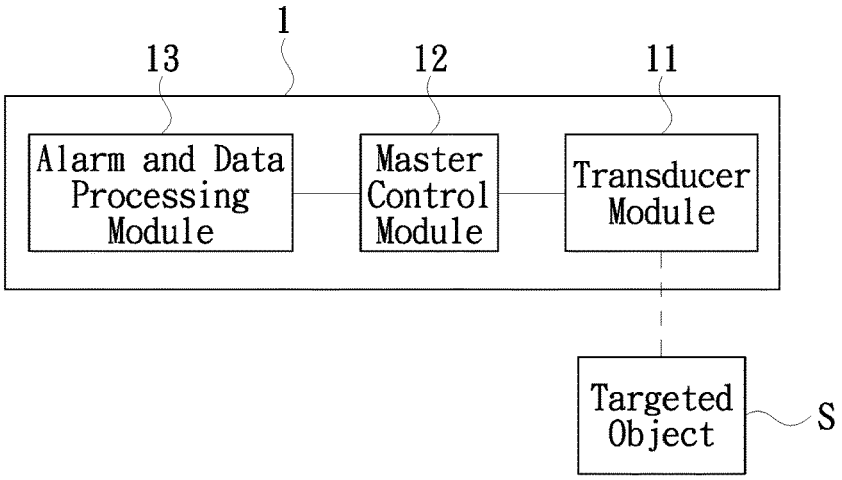
FIG. 1A is a schematic illustration of the configuration of an anti-theft data collection and processing apparatus according to an embodiment of the present invention.

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Based on the disadvantages of existing anti-theft devices, the present invention provides an anti-theft data collection and processing apparatus, and an anti-theft data collection and processing system of and a method for such apparatus.

The anti-theft data collection and processing apparatus of the present invention is capable of detecting if at least one targeted object is under a normal status and performing alarms (for example, releasing alarm signals) when detecting that the at least one targeted object is not under the normal status, therefore achieving anti-theft effects. In other words, the targeted object is the item protected by the anti-theft data collection and processing apparatus.

In the present invention, "normal status" refers to the condition under which the targeted object is being protected. Such condition may be, for example, the targeted object being at a certain location or located within a certain area, or not being illegally operated. It is to be understood that the "normal status" may be defined by the users according to the practical environments, and is not limited to any specific condition in the present invention.

In addition to collecting and processing information regarding whether the targeted object is under the "normal status," the data collection and processing apparatus of the present invention is capable of collecting various (relevant) information regarding the targeted object, such as other status information and/or operational information of the object, environmental information regarding the environment in which the object is located, and user information regarding the owner or user of the object. The "status information" of the object reflects all attributes information of the status of the object, including information indicating whether the object is under the "normal status." The "operational information" refers to information generated according to operations of the object by the user, including duration of operation and content of operation. The "environmental information" refers to the information regarding the environment in which the object is located, such as temperature, humidity, and intensities of light, electricity or magnetic field, as well as video or images of the environment (when surveillance cameras or probes are adopted). The user information regarding the owner or user of the object includes, for example, gender and age of the owner or user of the object.

The targeted object according to the present invention may be a cell phone, a tablet computer, a laptop, a digital camera, or other interactive electronic device. For example, when the targeted object is an electronic device and is electrically connected to the data collection and processing apparatus, the status information may include the status of connection between the data collection and processing apparatus and the electronic device, the operational information may include information regarding the interactive operations between the user and the object, the environmental information may include surveillance images, temperature, humidity and light intensity of the spatial area in which the electronic device is located, and the user information may include gender and age of the user of the electronic device.

The data collection and processing apparatus of the present invention may be associated with one or a plurality of targeted objects. That is, a data collection and processing apparatus of the present invention may collect and process relevant information of at least one targeted object.

In other words, the data collection and processing apparatus of the present invention may detect relevant information of at least one targeted object, such as information indicating whether the targeted object is under a "normal status."

The data collection and processing apparatus of the present invention may be an independent functional device, or be integrated into other electronic device or the targeted object. For example, the apparatus may be implemented by one or more components in a smartphone having all of the functional modules in accordance with the present invention. The functional modules may be constituted by hardware components or be implemented by common data processing device (for example, a CPU) that is capable of executing relevant programs or applications and having data processing capability.

The present invention also provides a data collection and processing method. According to the method, relevant information of at least one targeted object is collected, and status of the targeted object is determined. An alarm would be performed when the targeted object is determined to be not under the normal status. The collected relevant information may also be processed for performing interactive operations accordingly.

Referring now to FIG. 1A, which illustrates the configuration of an anti-theft data collection and processing apparatus according to an embodiment of the present invention. As shown in FIG. 1A, the anti-theft data collection and processing apparatus of the present invention includes a transducer module 11, a master control module 12 and an alarm and data processing module 13.

The transducer module 11 is configured to collect relevant information of a targeted object S. The information may contain status information, which may include the status of connection between the targeted object S and the data collection and processing apparatus 1 and positional status of the targeted object S, and operational information, which may include interaction between the user and the targeted object S and user information. The transducer module 11 would then transmit the relevant information to the master control module 12. The relevant information may be in any format, such as acoustic, light, electrical, mechanical, or scent. The transducer module 11 may be any type of transducers, including mechanical switch, MEMS transducer, Hall effect transducer switch, infrared transducer, proximity transducer, and camera transducer, and may collect data and images.

For example, if the transducer module 11 is a mechanical switch connecting to a targeted object, the master control module 12 would be notified once the status of the mechanical switch is altered. If the transducer module 11 is a Hall effect transducer switch, the master control module 12 would be notified once the status of the Hall switch is altered. If the transducer module 11 is a transducer capable of detecting the presence of the targeted object within a certain area, such as an infrared transducer, a MEMS transducer, a proximity transducer or a camera transducer, the positional status and other information of the targeted object would be reported to the master control module 12. Furthermore, when the user interacts with the targeted object, the transducer module 11 may also record the operational, environmental and user information of the interaction, such as age, gender and facial expression of the user, image of the space in which the targeted object is located, and duration and steps of the user operation, which are then sent to the master control module 12.

The master control module 12 is configured to determine if the targeted object is under a "normal status" and to transmit an alert signal to the alarm and data processing module 13 when the targeted object is determined to be not under the "normal status." The master control module 12 is also configured to transmit relevant information received from the transducer module 11, including user information and operational information regarding interactions between the user and the targeted object, to the alarm and data processing module 13. The master control module 12 may be implemented by a microprocessor or other component with digital processing capability, such as a FPGA or DSP.

The alarm and data processing module 13 is configured to process the alert signal sent from the master control module 12 and perform an alarm, such as activating an alarm annunciator to set off an alarm. The alert and data processing module 13 is also configured to process relevant information received from the master control module 12 and perform interactive operations accordingly. The interactive operations may be performed in acoustic, light, electrical, scent, or mechanical formats. The alarm and data processing module 13 may be implemented by an independent processor coupled with components with related functions, and may share the processor with the master control module 12.

Figure 1B:
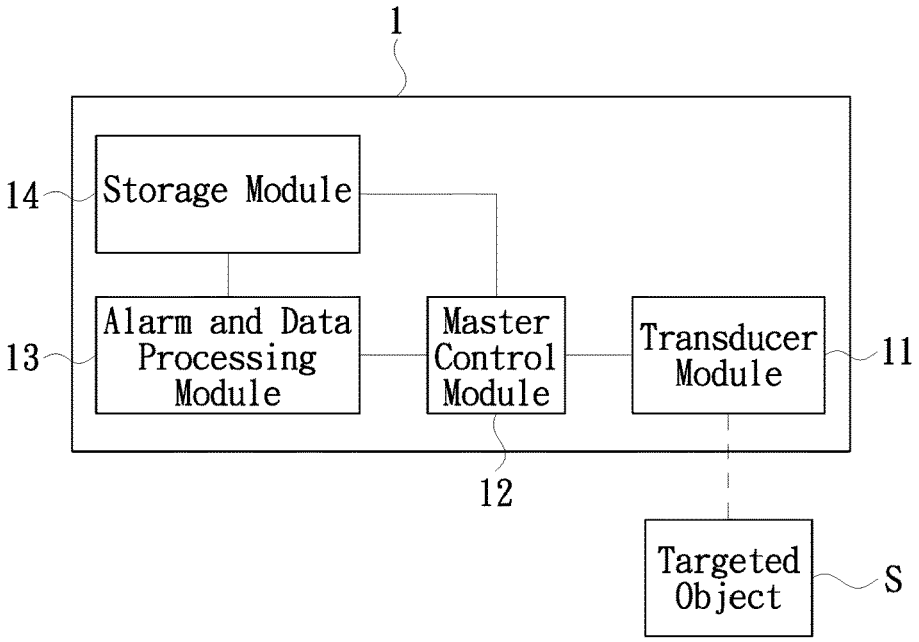
FIG. 1B is a schematic illustration of the configuration of an anti-theft data collection and processing apparatus according to an embodiment of the present invention.

Referring now to FIG. 1B, which illustrates the configuration of an anti-theft data collection and processing apparatus according to another embodiment of the present invention. Different from the configuration illustrated in FIG. 1A, the data collection and processing apparatus of the present embodiment further includes a storage module 14. The storage module 14 is configured to store the relevant information and data generated by the master control module 12 or generated upon processing of the relevant information by the alarm and data processing module 13. The storage module 14 may be implemented by any storage device with read and write function, such as NAND Flash Memory, mini-SD, T-Flash, RS-MMC.

Figure 1C:
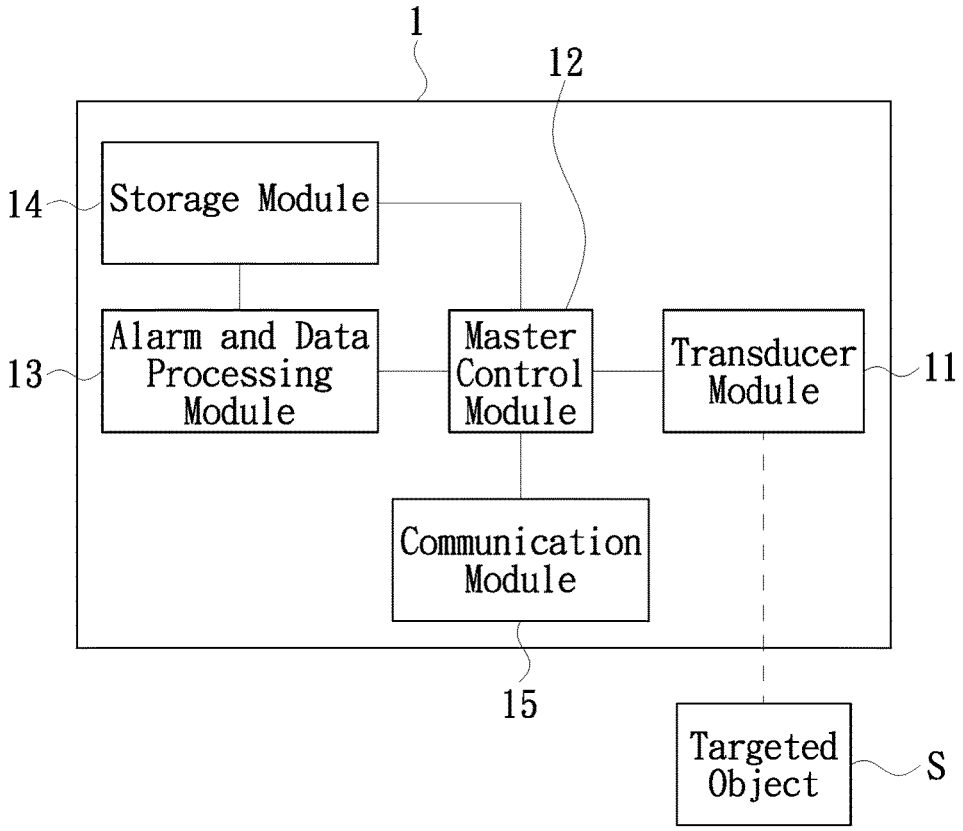
FIG. 1C is a schematic illustration of the configuration of an anti-theft data collection and processing apparatus according to yet another embodiment of the present invention.

Referring now FIG. 1C, which illustrates the configuration of an anti-theft data collection and processing apparatus according to yet another embodiment of the present invention. Different from the configuration illustrated in FIG. 1B, the data collection and processing apparatus of the present embodiment further includes a communication module 15.

The communication module 15 is configured to transmit the alert signal received from the master control module 12 to an external device that is capable of processing the alert signal, and to transmit information collected by the transducer module 11 regarding the targeted object to an external device that is capable of processing the relevant information. The communication module 15 may or may not be connected to the Internet, and data communication thereof may be wired or wireless by utilizing, for example, near filed communication (NFC), Bluetooth, WiFi, 2G/3G/LTE mobile network or frequency modulation (FM). More specifically, data exchange may be performed without Internet connection by using NFC, Bluetooth, infrared or WiFi, or with Internet connection by using 2G/3G/LTE or other Internet connection means. The present invention is not limited to the aforementioned data communication methods.

Figure 2A:
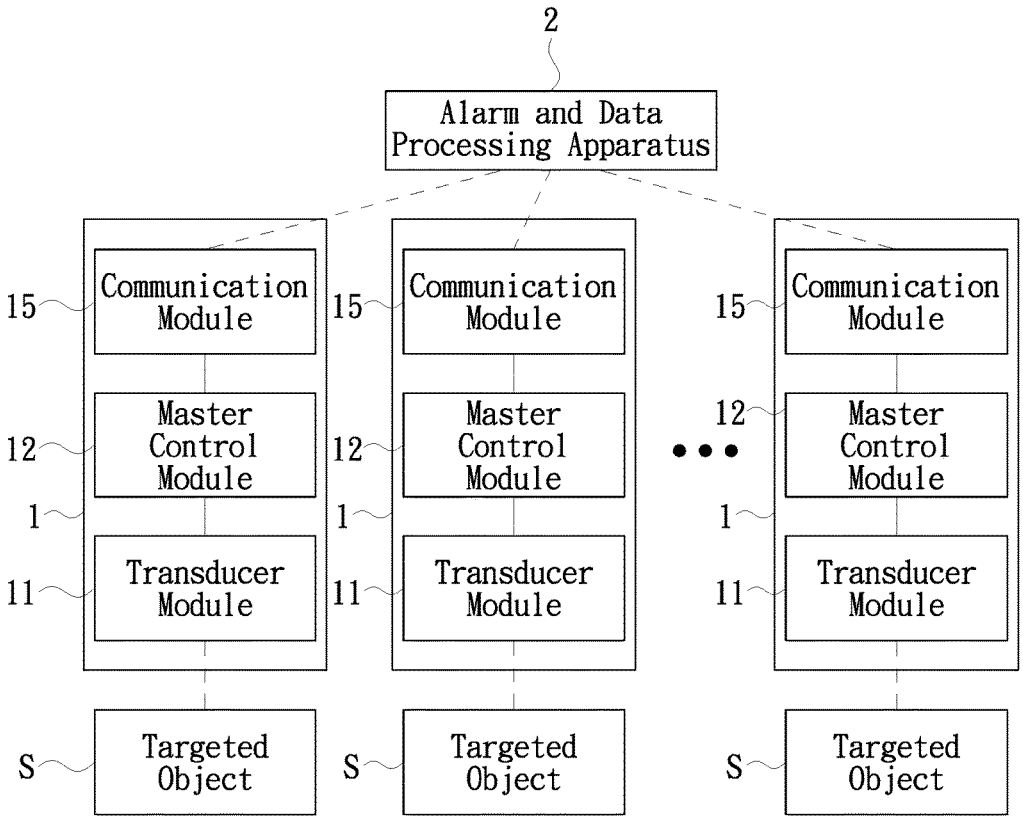
FIG. 2A is a schematic illustration of an anti-theft data collection and processing system according to an embodiment of the present invention.
Figure 2B:
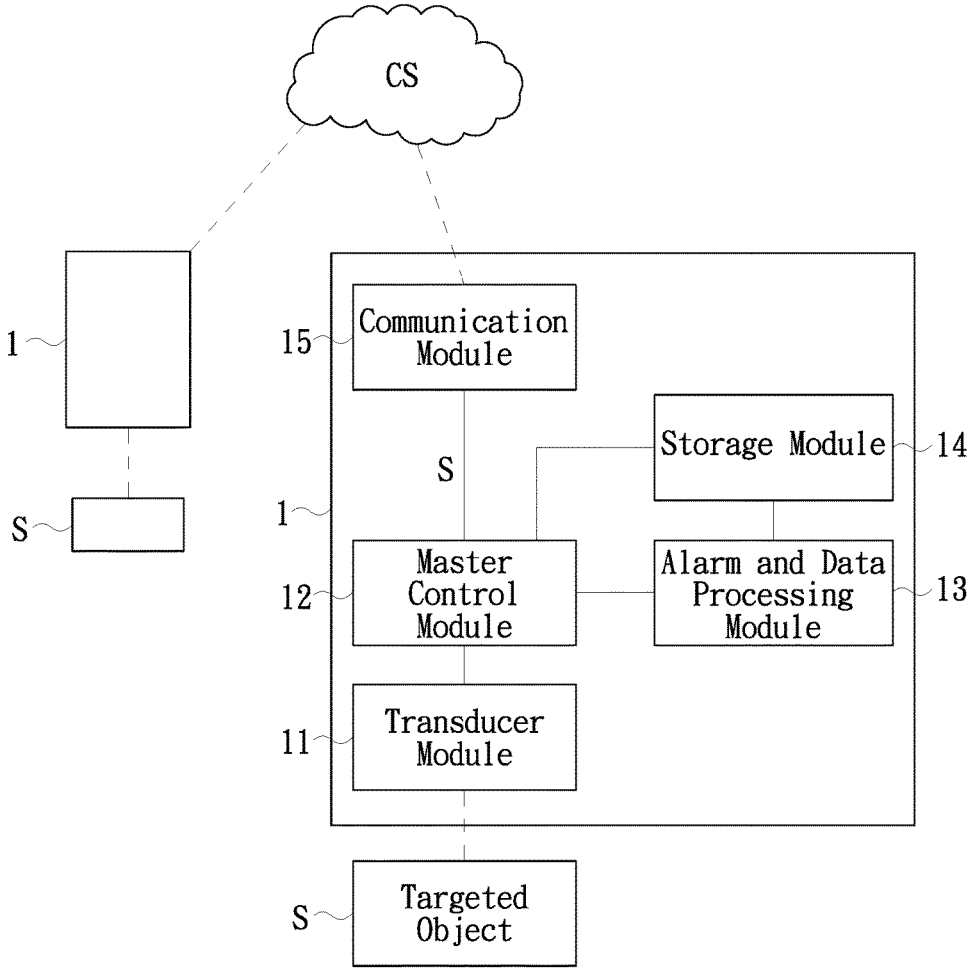
FIG. 2B is a schematic illustration of an anti-theft data collection and processing system according to another embodiment of the present invention.

Referring now to FIGS. 2A and 2B, each illustrating an anti-theft data collection and processing system of the present invention.

As shown in FIG. 2A, the system includes at least one data collection and processing apparatus 1 and an alarm and data processing apparatus 2. The data collection and processing apparatuses 1 and the alarm and data processing apparatus 2 are communicated by wired or wireless connection.

The data collection and processing apparatuses 1 are configured to collect relevant information of at least one targeted object S, and transmit the collected relevant information to the alarm and data processing apparatus 2. The relevant information includes information indicating whether the targeted object S is under a "normal status". An alarm would be performed when the alarm and data processing apparatus 2 processes the relevant information and determines that the targeted object S is not under a normal status.

The data collection and processing apparatuses 1 of the system in the present embodiment are similar to the data collection and processing apparatus 1 of the previous embodiments. The difference is that the data collection and processing apparatuses of the present embodiment do not include the alarm and data processing module 14. However, the data collection and processing apparatuses each has a communication module 15.

Each transducer module 11 of the data collection and processing apparatuses 1 may detect the relevant information of at least one object S.

The communication modules 15 are configured to transmit alert signals received from the master control module 12 to the alarm and data processing apparatus 2, and to transmit relevant information collected by the transducer module 11 regarding the targeted object S to the alarm and data processing apparatus 2. The communication modules 15 may or may not be connected to the Internet, and data communication thereof may be wired or wireless by utilizing, for example, NFC, Bluetooth, WiFi, 2G/3G/LTE or FM. More specifically, data exchange may be performed without Internet connection by using NFC, Bluetooth, infrared or WiFi, or with Internet connection by using 2G/3G/LTE or other Internet connection means. The present invention is not limited to the aforementioned data communication methods.

The alarm and data processing apparatus 2 is configured to receive alert signals or status and operational information from any of the data collection and processing apparatus 1, and perform alarms according to the alert signals or interactive operations according to the status and operational information.

Additionally, each of the data collection and processing apparatuses 1 further includes an alarm and data processing module 13 (not shown). The alarm and data processing module 13 is configured to process the alert signals received from the master control module 12 and perform alarms accordingly, and to process relevant information sent from the master control module 12 or perform interactive operations accordingly. The master control module 12 is also configured to determine if sending the alert signals and the relevant information to the alarm and data processing module 13 or to the alarm and data processing apparatus 2.

Each of the data collection and processing apparatuses 1 may further includes a storage module 14 for storing relevant information and data generated by the master control module 12 or generated upon processing of the relevant information by the alarm and data processing module 13.

Referring now to FIG. 2B. Similar to the system shown in FIG. 2A, the anti-theft data collection and processing system in the present embodiment as illustrated in FIG. 2B includes at least one data collection and processing apparatus 1, each collecting and processing relevant information of a targeted object S.

However, different from the embodiment shown in FIG. 2A, the data collection and processing apparatuses 1 of the present embodiment employ the data collection and processing apparatus shown in FIG. 1C. In other words, in addition to the transducer module 11, the master control module 12 and the communication module 15 as in the data collection and processing apparatus 1 illustrated in FIG. 2A, the present embodiment further includes the alarm and data processing module 13 and the storage module 14. Functions of the alarm and data processing module 13 and the storage module 14 are identical to those in the embodiments illustrated in FIGS. 1A and 1B; therefore, detailed descriptions on the two modules are not repeated herein.

Furthermore, all of the data collection and processing apparatus 1 are connected to a cloud server CS. As each of the data collection and processing apparatus 1 forms a distributed data processing network, the cloud server CS is configured to receive and process relevant information received from each of the data collection and processing apparatus 1 regarding the targeted object S, and to transmit the processing results to each of the data collection and processing apparatus 1 for interactive operations to be performed thereby.

The master control module 12 of the data collection and processing apparatus is also configured to determine if sending the relevant information to the internal alarm and data processing module 13 or to the external cloud server CS for processing.

The cloud server CS may, but is not limited to, be configured according to any existing distributed computing principles.

However, it is to be understood that each of the data collection and processing apparatuses 1 adopting the data collection and processing system as shown in FIG. 2B may, or may not, include the alarm and data processing module 13. When the alarm and data processing module 13 is not included, all of the relevant information would be sent to the cloud server CS for processing.

To more clearly demonstrate the purposes, technical schemes and advantages of the present invention, the present invention will now be described more specifically with reference to the following embodiments.

Embodiments

Figure 3:
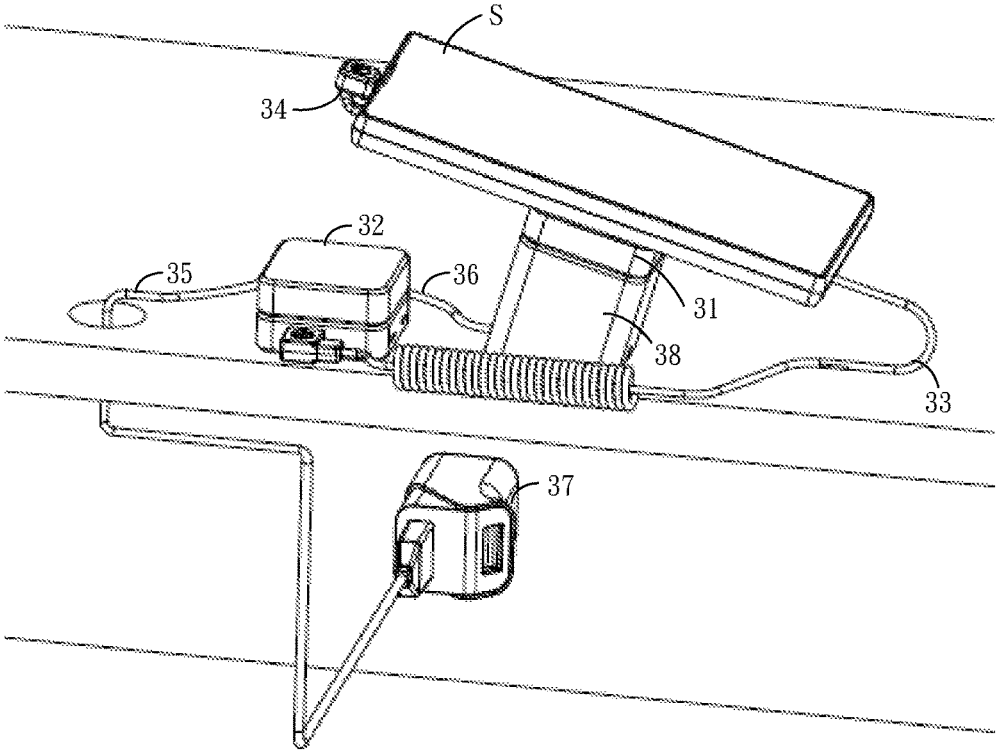
FIG. 3 is an schematic illustration of an anti-theft data collection and processing apparatus according to an embodiment of the present invention.
Figure 4:
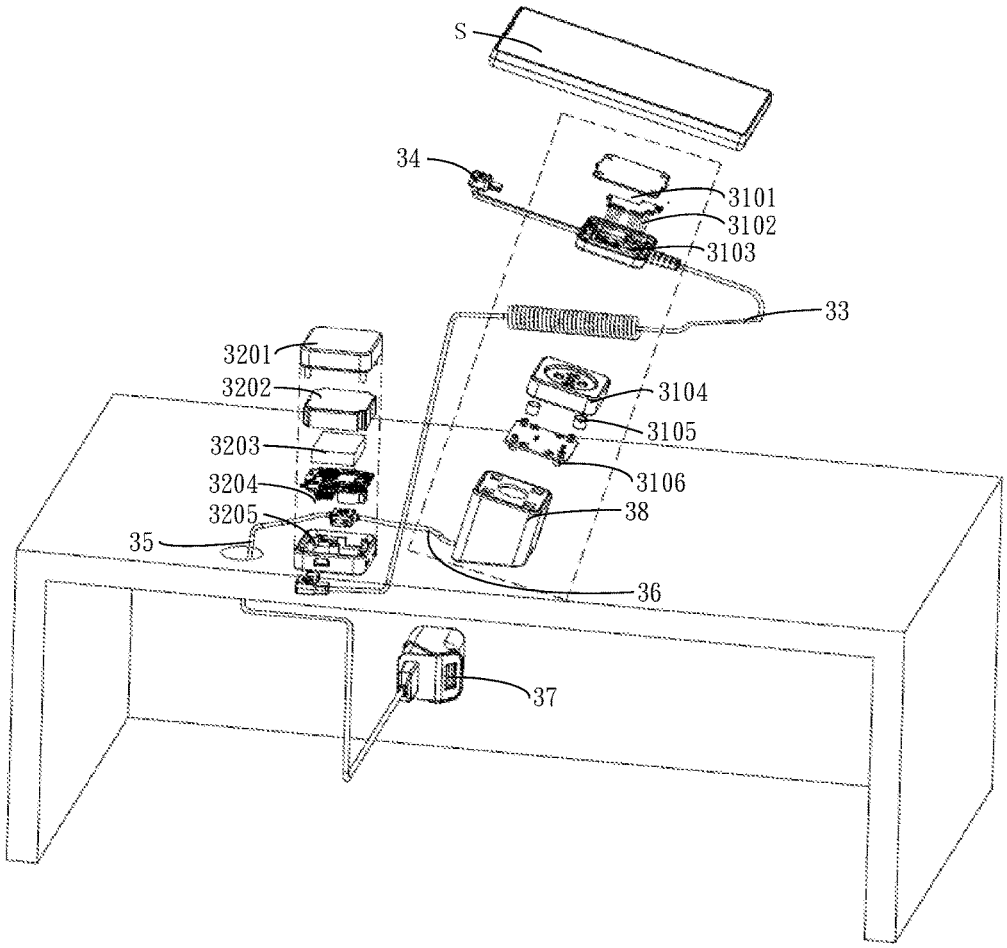
FIG. 4 is a an exploded view of the anti-theft data collection and processing apparatus according to the embodiment of the present invention.

Referring now to FIGS. 3 and 4, which illustrate the perspective view and exploded view of an anti-theft data collection and processing apparatus according to an embodiment of the present invention. As shown in FIG. 3, the data collection and processing apparatus of the present embodiment includes a transducer 31 and a data processing center 32.

As shown in FIG. 3, the targeted object S is a cell phone and is attached to the transducer 31. The targeted object S also communicates with the transducer 31 via a sensor wire 34, which also provides electricity to the targeted object S. The data collection and processing apparatus 1 is connected to the power source 37 via an electrical wire 35. The data processing center 32 is connected to the transducer 31 via two wires, one of which is a data wire 33 for data transmission and the other is a power wire 36 for providing electricity to the transducer 31. The base 38 is adopted for supporting the transducer 31 and the targeted object S.

Referring now to FIG. 4. As shown in FIG. 4, the data processing center 32 includes an upper cover 3201, an antenna assembly 3202, a battery 3203, a mainboard 3204, and a lower cover 3205. The upper cover 3201 and the lower cover 3202 are assembled for accommodating and protecting the antenna assembly 3202, the battery 3203 and the mainboard 3204. The antenna assembly 3202 is configured to transmit data collected by the mainboard 3204 wirelessly to an external alarm and data processing apparatus. The antenna assembly 3202 may, but is not limited to, utilize NFC, Bluetooth, WiFi, 2G/3G/LTE or FM. The battery 3203 is configured to provide uninterrupted power when the processing center 32 is not connected to the external electrical wire 35 or is experiencing a power shutdown during operation. The mainboard 3204 is a mechanical and electrical component configured to process alert and data collection signals.

As shown in FIG. 4, the transducer 31 includes an upper cover 3101, a mainboard 3102, a lower cover 3103, a base top part 3104, a magnet 3105 and a base bottom part 3106. The upper cover 3101 and the lower cover 3103 are assembled for accommodating and protecting the mainboard 3102. The mainboard 3102 is configured to collect acoustic, light, electrical, mechanical or scent information generated when a positional change of the targeted subject S occurs, and transmit the information to the processing center 32 via the data wire 33. For example, when the transducer senses that the targeted object is lifted up by a user, the data collection and processing apparatus would generate a "Welcome" voice along with a light change.

As shown in FIG. 4, the base top part 3104 and the base bottom part 3106 of the transducer 31 are assembled for protecting and positioning the magnet 3105. In the present embodiment, the magnet 3105 is configured to define an origin spot of the targeted object. Data collection according to the present embodiment is performed by the magnet 3105 in the base triggering the Hall component in the transducer 31; the Hall component is switched on and the transducer 31 transmits open signals to the processing center 32 via the data wire 33 when the magnetic field lines of the magnet 3105 pass through the Hall component; and the Hall component is switched off and the transducer 31 transmits close signals to the processing center 32 via the data wire 33 when the transducer leaves the base and the magnetic field lines of the magnet 3105 passing through the Hall component is no longer sufficient.

In the present embodiment, the transducer module 11 of the present invention is implemented by the transducer 31, the communication module 15 is implemented by the antenna assembly 3202, and the alarm and data processing module 13, the master control module 12 and the storage module 14 are implemented by the mainboard 3204 in the data processing center 32.

Figure 5:
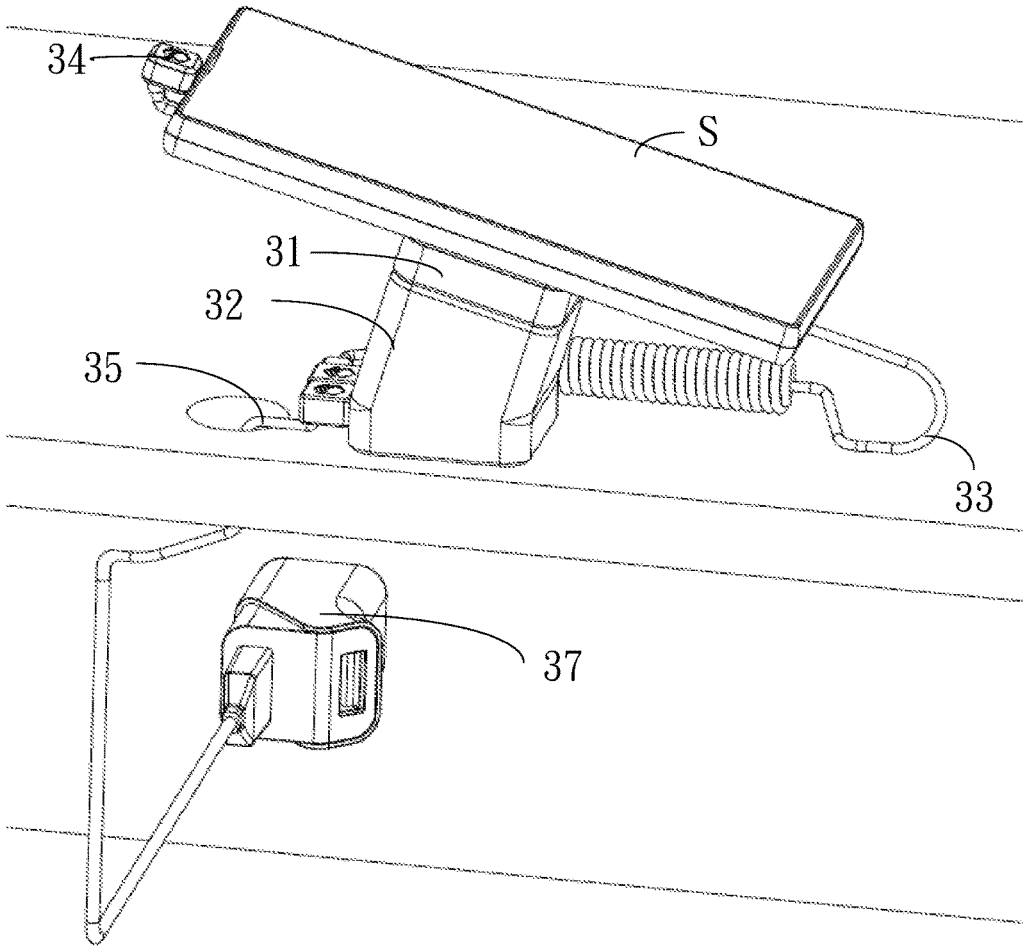
FIG. 5 is an schematic illustration of an anti-theft data collection and processing apparatus according to another embodiment of the present invention.
Figure 6:
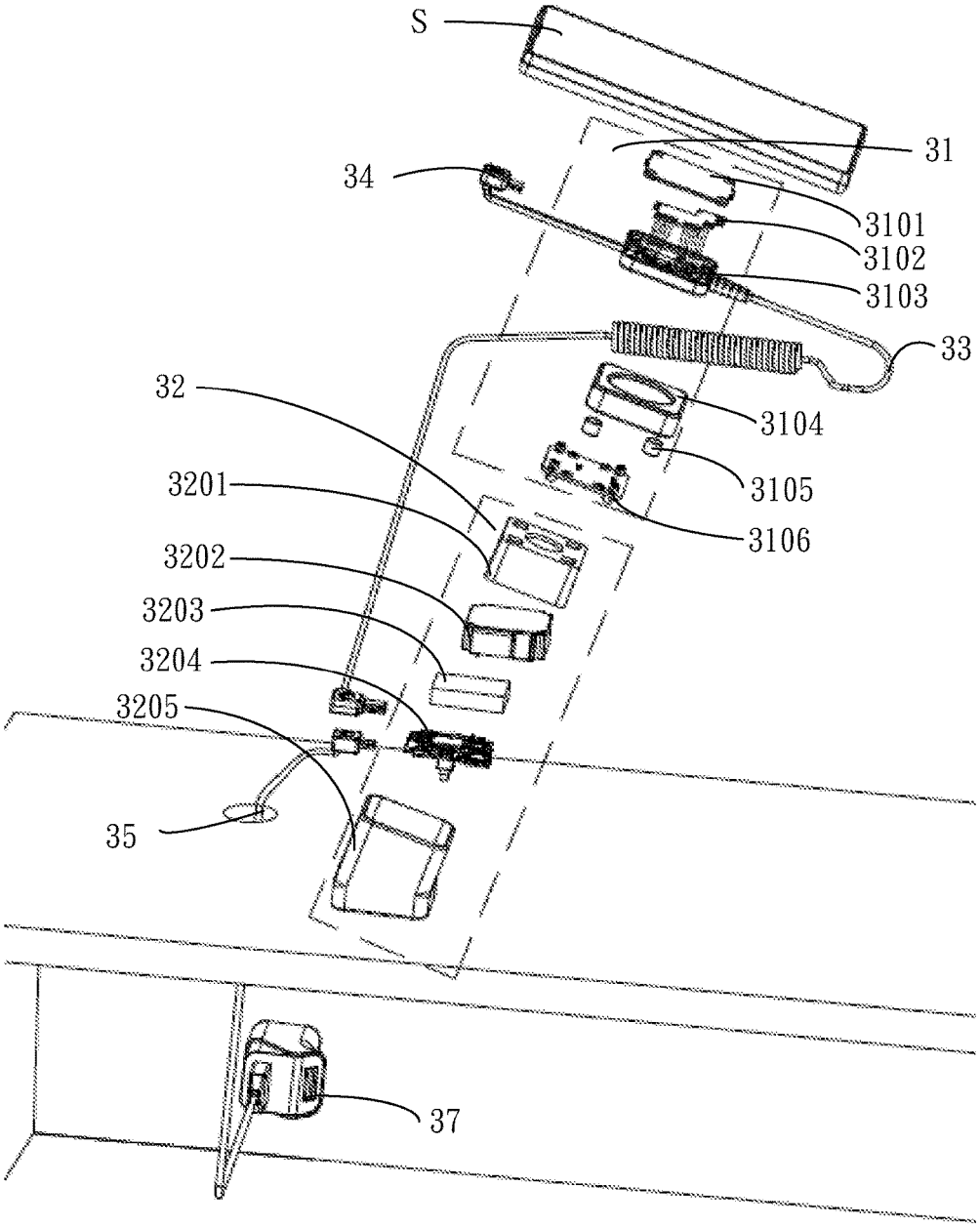
FIG. 6 is an exploded view of the anti-theft data collection and processing apparatus according to the other embodiment of the present invention.

Referring now to FIGS. 5 and 6, which illustrates the perspective view and exploded view of an anti-theft data collection and processing apparatus according to another embodiment of the present invention. Different from the previous embodiment, the data processing center of the present embodiment is integrated into the base.

In the present embodiment, the mainboard 3204 of the processing center 32 and the mainboard 3102 of the transducer 31 may be integrated into one mainboard, or may be separated into a plurality of mainboards.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A data collection and processing apparatus with anti-theft function, wherein the data collection and processing apparatus is configured for collecting and processing relevant information regarding at least one targeted object, the relevant information comprises information indicating whether the targeted object is under a normal status;

the data collection and processing apparatus is also configured for processing the relevant information and performing an alarm when detecting that the targeted object is not under the normal status;

wherein the relevant information comprises status information of the targeted object and user information of an owner or a user of the targeted object.

2. The data collection and processing apparatus with anti-theft function according to claim 1, comprising a transducer module, a master control module and an alarm and data processing module, wherein the transducer module is configured for collecting the relevant information of the targeted object;

the master control module is configured the determining if the targeted object is under the normal status, transmitting an alert signal to the alarm and data processing module when the targeted object is determined to be not under the normal status, and transmitting the relevant information received from the transducer module to the alarm and data processing module;

the alarm and data processing module is configured for processing the alert signal received from the master control module, performing and alarm, and processing the relevant information transmitted by the master control module and performing corresponding interactive operations.

3. The data collection and processing apparatus according to claim 2, further comprising a communication module configured for transmitting the alert signal received from the master control module to an external device capable of processing the alert signal, and transmitting the relevant information targeted object acquired by the transducer module to the external device capable of processing the relevant information.

4. The data collection and processing apparatus according to claim 2, further comprising a storage module configure for storing the relevant information and data generated by the master control module or generated upon processing of the relevant information by the alarm and data processing module.

5. The data collection and processing apparatus according to claim 4, further comprising a communication module configured for transmitting the alert signal received from the master control module to an external device capable of processing the alert signal, and transmitting the relevant information of the targeted object acquired by the transducer module to the external device capable of processing the relevant information.

6. A data collection and processing system, comprising at least one data collection and processing apparatus communicating with an alarm and data processing apparatus or a cloud server via a wired connection or a wireless connection, wherein the data collection and processing apparatus is configured for collecting relevant information regarding at least one targeted object and transmitting the relevant information to the alarm and data processing apparatus, the relevant information comprises information indicating whether the targeted object is under a normal status, the alarm and data processing apparatus is configured for processing the relevant information and performing an alarm when detecting that the targeted object is not under the normal status, and the cloud server is configured for receiving and processing the relevant information of the targeted object from the data collection and processing apparatus and transmitting processing results to the data collection and processing apparatus for the data collection and processing apparatus to perform interactive operations;

wherein the relevant information comprises status information of the targeted object and user information of an owner or a user of the targeted object.

7. The data collection and processing system according to claim 6, wherein the data collection and processing apparatus comprises a transducer module, a master control module and a communication module, wherein the transducer module is configured for collecting the relevant information of the targeted object, the master control module is configured for determining if the targeted object is under the normal status, transmitting an alert signal to the alarm and data processing module when the targeted object is determined to be not under the normal status, and transmitting the relevant information received from the transducer module to the alarm and data processing module, and the communication module is configured for transmitting the alert signal received from the master control module to the alarm and data processing apparatus, and transmitting the relevant information of the targeted object acquired by the transducer module to the alarm and data processing apparatus.

8. The data collection and processing system according to claim 7, wherein the data collection and processing apparatus further comprises an alarm and data processing module, and the alarm and data processing module is configured for processing the alert signal received from the master control module, performing an alarm, and processing the relevant information transmitted by the master control module and performing corresponding interactive operations.

9. The data collection and processing system according to claim 8, wherein the data collection and processing apparatus further comprises a storage module configured for storing the relevant information and data generated by the master control module or generated upon processing of the relevant information by the alarm and data processing module.

10. The data collection and processing system according to claim 6, wherein the data collection and processing apparatus comprises a transducer module, a master control module, an alarm and data processing module and a communication module, the transducer module is configured for collecting the relevant information regarding the at least one targeted object, the master control module is configured for determining if the targeted object is under the normal status, transmitting an alert signal to the alarm and data processing module when the targeted object is determined to be not under the normal status, and transmitting the relevant information received from the transducer module to the alarm and data processing module or the cloud server, the alarm and data processing module is configured for processing the relevant information and performing the alarm when detecting that the targeted object is not under the normal status, and processing the relevant information transmitted by the master control module and performing the interactive operations, and the communication module is configured for transmitting the alert signal received from the master control module to the alarm and data processing module, and transmitting the relevant information of the targeted object acquired by the transducer module to the alarm and data processing module or the cloud server.

11. The data collection and processing system according to claim 10, wherein the data collection and processing apparatus further comprises a storage module configured for storing the relevant information and data generated by the master control module or generated upon processing of the relevant information by the alarm and data processing module.

12. A data collection and processing method, comprising steps of:

collecting relevant information regarding at least one targeted object, the relevant information includes information indicating whether the targeted object is under a normal status; and determining if the target object is under the normal status, and performing an alarm when determining that the targeted object is not under the normal status;

wherein the relevant information comprises status information of the targeted object and user information of an owner or a user of the targeted object.

13. The data collection and processing method according to claim 12, further comprising a step of:

processing the collected relevant information and performing corresponding interactive operations.

14. The data collection and processing method according to claim 13, wherein the relevant information is processed by a distributed data collection and processing system.

* * * * *